US008079207B2

(12) United States Patent
Galan Llongueras

(10) Patent No.: US 8,079,207 B2
(45) Date of Patent: Dec. 20, 2011

(54) THREAD TWIST SYSTEM FOR TWISTING AND SPINNING MACHINES

(75) Inventor: Jordi Galan Llongueras, Terrassa (ES)

(73) Assignee: Frimal Trading S.L., Barcelona (ES)

( * ) Notice: Subject to any disclaimer, the term of this patent is extended or adjusted under 35 U.S.C. 154(b) by 0 days.

(21) Appl. No.: 12/600,684

(22) PCT Filed: May 9, 2008

(86) PCT No.: PCT/ES2008/000331

§ 371 (c)(1),
(2), (4) Date: Apr. 12, 2010

(87) PCT Pub. No.: WO2008/142181

PCT Pub. Date: Nov. 27, 2008

(65) Prior Publication Data

US 2010/0223900 A1 Sep. 9, 2010

(30) Foreign Application Priority Data

May 18, 2007 (ES) ..... 200701435

(51) Int. Cl.
*D01H 7/52* (2006.01)
*D01H 13/32* (2006.01)

(52) U.S. Cl. ..... 57/75; 57/264

(58) Field of Classification Search ..... 57/75, 264, 57/265

See application file for complete search history.

(56) References Cited

U.S. PATENT DOCUMENTS

| | | | | | |
|---|---|---|---|---|---|
| 3,943,689 | A * | 3/1976 | Kunz et al. | 57/264 |
| 4,023,342 | A * | 5/1977 | Schenkel | 57/264 |
| 4,420,697 | A * | 12/1983 | Fiedler et al. | 327/509 |
| 4,648,054 | A | 3/1987 | Farah | |
| 4,788,818 | A * | 12/1988 | Meissner | 57/264 |
| 4,809,491 | A * | 3/1989 | Heinen et al. | 57/125 |
| 5,590,045 | A * | 12/1996 | Kaak et al. | 700/139 |
| 5,660,035 | A * | 8/1997 | Musha et al. | 57/264 |
| 5,813,210 | A * | 9/1998 | Musha et al. | 57/264 |
| 6,112,508 | A * | 9/2000 | Felix | 57/265 |
| 2008/0308664 | A1 * | 12/2008 | Vega et al. | 242/364.7 |

FOREIGN PATENT DOCUMENTS

| | | |
|---|---|---|
| EP | 0480898 | 4/1992 |
| GB | 2196351 | 4/1988 |
| JP | 55051825 | 4/1980 |
| WO | 8400781 | 3/1984 |
| WO | 9815677 | 4/1998 |
| WO | 2006136747 | 12/2006 |

* cited by examiner

*Primary Examiner* — Shaun R Hurley
(74) *Attorney, Agent, or Firm* — Sturm & Fix LLP

(57) ABSTRACT

Thread twist system for twisting and spinning machines which comprises means (12) for measuring and/or calculating directly or indirectly the rotation speed (11) of the runner (5), in such a way that the working movements and parameters of the machine keep real twisting constant throughout the process of filling the reel (2) in a dynamic and instantaneous way, by acting on the angular speed (10) of the spindles (1) and/or the feeding (9) speed of the thread (6), with the objective of correcting the theoretical twisting on the thread itself (6) and converting it into real twisting.

4 Claims, 1 Drawing Sheet

THREAD TWIST SYSTEM FOR TWISTING AND SPINNING MACHINES

OBJECT OF THE INVENTION

The object of the present invention relates to a new thread twist system for twisting and spinning machines.

BACKGROUND OF THE INVENTION

In the thread twisting industry, one of the most traditional machines that provides the torsion for one or more threads or fibres is the twister and the spinner.

The twisting and rolling or folding process on the reel of these machines is carried out by a rotating spindle system and the ring that guides the runner, the rocker that distributes the thread along the spindle, filling the reel, and the thread feeding. The ratio of the spindle speed to the thread feed speed is constant throughout the reel filling process and corresponds to the theoretical torsion of the programmed thread.

These conventional machines work (amongst others) with some working parameters such as torsions per meter of thread, thread feed speed and spindle revolutions per minute, and fulfills the theoretical expression:

Torsions per meter (THEORETICAL)=spindle speed (rpm)/spindle lineal speed (m/min)

This means that in the case of wanting to increase or reduce the spindle lineal speed, the spindle rotation speed increases or reduces by the same proportion, without varying the torsion, for the purpose of keeping constant the theoretical programmed tension value.

Therefore, even though it is known that on these machines the working speeds can be varied during the reel filling for the purpose, amongst others, of reducing the thread breakages, they have always fulfilled this formula and have always changed in the same proportion and at the same time the spindle rotational speed and the thread lineal speed and the (theoretical) torsion per meter value has always been kept constant.

Owing to the imperfect working principle of the system, during this twisting and reel filling process, actually a series of torsion divergences are produced on the thread compared to the programmed theoretical torsion. This means that having a programmed theoretical torsion on the machine, the real torsion on the thread once twisted is always different and variable depending on the portion of thread chosen from the reel.

These torsion variations depend on the runner that moves at a different turning speed to that of the spindle and which is variable throughout the reel filling. Said runner speed depends and is basically related to the spindle speed, the thread feed speed, the speed and the direction (up-down) of the rocker movement and the thread rolling diameter at a specific moment.

This variation of runner speed makes the thread roll onto the reel along the formation of the reel with a real torsions per meter value different to that which is theoretically programmed, as on the conventional machines it is always fulfilled the expression:

Torsions per meter (THEORETICAL)=spindle speed (rpm)/thread lineal speed (m/min)

Certainly with this 'conventional' working system, actually when the machine operator programmes the torsions per meter of thread to be processed, to a large extent it is unknown that actually the real torsions on the thread will be different to those programmed (theoretical). This ignorance and the ever increasing need to process threads with greater twist quality, less torsion variation, and as a consequence the improved mechanical properties that are the result once having been twisted have brought about the development of this invention.

DESCRIPTION OF THE INVENTION

In order to remedy the above mentioned irregularities the present invention has been developed, that is applicable to twisting and spinning machines in which the traditional theoretical torsion parameter has been replaced by the new real torsion parameter, which allows the thread to be actually and exactly produced and twisted with the real torsion required and kept throughout the reel filling process.

The system consists of the obtaining of the rotational speed of the runner during the process by means of suitable detection and/or calculation, and to keep constant the following ratio:

The torsions per meter (REEL) is directly proportional to the rotational speed of the runner and inversely proportional to the thread feed speed.

Being constant throughout the reel filling process in an instantaneous manner by modifying the thread feed speed or the spindle(s) speed, making said variation instantly and dynamically on one of these two movements or the two in combination at the same time for the purpose of maintaining the programmed real torsion instructions. Unlike other current systems in the state of the art, in the filed invention the fact of working on the spindle speed and/or the feed speed has the object of bringing about a correction on the theoretical torsion of the thread and converting into real.

In this way improvements in the mechanical properties of the twisted threads are obtained on processing them with much smaller (theoretically nil) torsion variation to that in the 'conventional' system.

In the event of wanting to vary the working speed throughout the reel filling, with this working system that is the object of the invention, the above described ratio is maintained, varying the runner speed and the thread lineal speed in the same proportion and at the same time and thus maintaining the instruction torsion per meter (real) value.

Other characteristics and advantages of the present invention will become clear from the description of the preferred embodiment, which is not exclusive, shown in the drawings by way of illustration but without being in any way limiting.

Preferred Embodiment of the Invention

Figure 1:
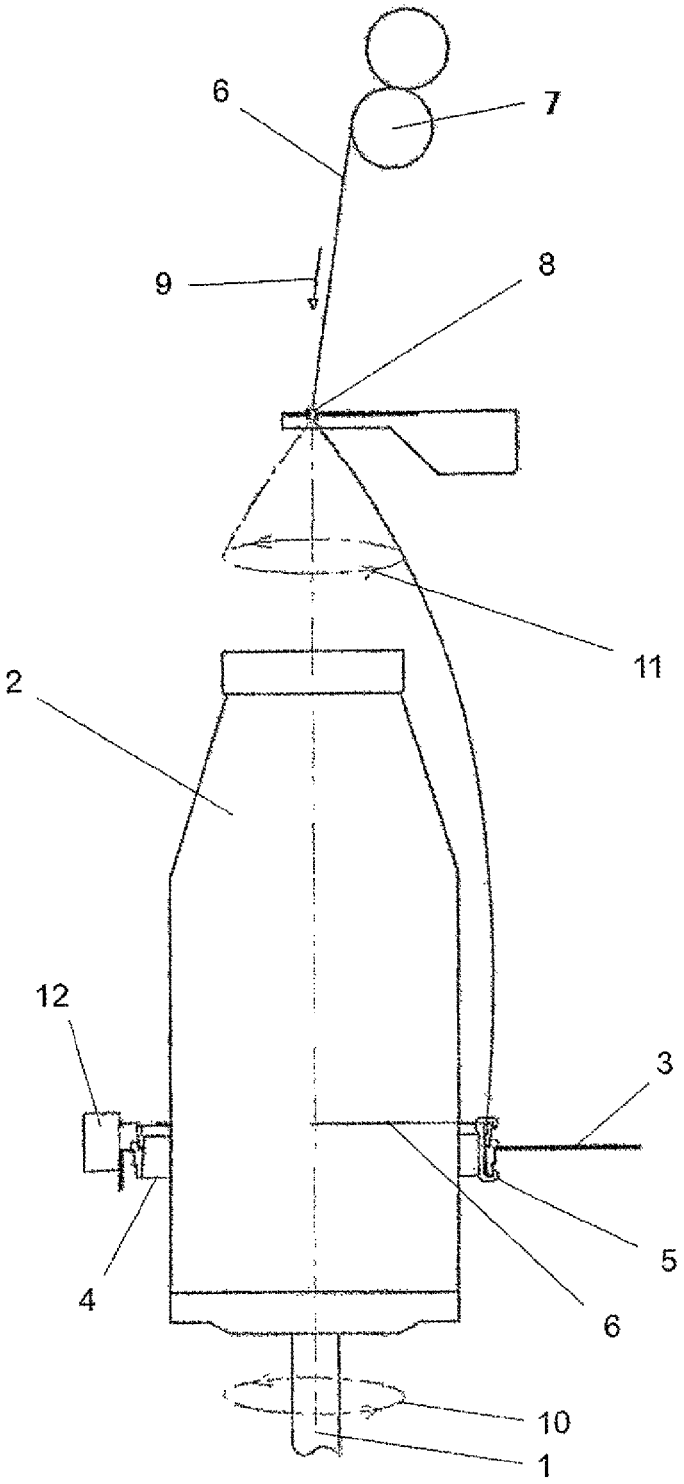
FIG. 1 is a schematic view of a twisting and spinning machine according to the invention.

In a first preferred embodiment, and referring to FIG. 1, a distinction can be made between the following parts of the machine:

The spindle (1) with the reel (2) that turns on its own axis at the spindle speed in RPM (10), the rocker (3) with the ring (4) and the runner (5) turning guided by the ring at the "runner speed in RPM" (11) and driven by the thread (6), the thread (6) feed speed with its feed pulley (7) at the speed "feed VEL m/min (9)" and the thread guide (8).

The required value, amongst others, is introduced into the machine corresponding to the degree of real torsion on the thread that is to be processed as to the feed speed (9). The revolutions per minute for the runner (11) at which the runner (5) must rotate are calculated from the above mentioned expression which stated in another way is:

Runner speed (rpm)=Torsion per meter (REAL)
*thread feed speed (m/min)

Said runner speed instruction will be the one which must be maintained by the read value of the runner (11) RPM, signal which is received from the machine by means that will be described later, and is sent directly to the machine processor or directly to the frequency converter that governs the concerned motor, which in a dynamic and instantaneous manner regulates and varies the speed of the spindles (10) and/or the feed speed (9) of the pulley (7) by the corresponding frequency converters so as to dynamically maintain said signal. The fact of acting on the speed of the spindles (10) and/or the feed speed (9) makes it bring about a correction on the theoretical torsion and converts it into real.

There are different ways, within the state of the art, so as to be able to calculate, measure and obtain the runner RPM (11) in the machine whilst it is filling the reel (2). Whatever the system is for measuring or calculating the runner RPM, it is not an essential part and it can be used in any practical embodiment of the present invention.

To be highlighted:

In FIG. 1: An ultrasound technology sensor (12) located on the rocker at the runner (5) level on top of the ring (4) and orientated perpendicular to the reel (2) axis, it gives off an analogue signal proportional to the distance between the sensor and the body in which it is aimed (in this case, the average distance, gives information related to the diameter of the reel (2) filling at a specific moment). Therefore, we can extrapolate by formulas and know the value for the runner (11) RPM at all times of the reel filling.

There are also completely indirect ways of calculating or knowing the runner speed without any type of sensor, by formulas in which there are other parameters and data at all times, such as the initial and final diameter of the reel, the position of the rocker, the direction and speed of movement of the rocker up and down, the final meters and dimensions of the full reel, the dimensions of cylindrical and conical part of the reel, and if one has these data the runner speed can be calculated in an indirect way. In these cases it is also considered as a preferred embodiment of the invention as the working methods of the machine keep being the claimed.

If the kinematic scheme that makes up the machine, is one or several spindle motors and one or several feed motors, but all of the spindles and feeds working in a collective manner, this means at the same speed for all of the spindles and the same speed for all of the feeds, with one sensor (10) at least on a spindle can be enough to make it work.

In the case the machine can process with different torsions for each spindle or groups of spindles, one sensor (10) will be needed for each one of these spindles or groups of spindles.

The machine can work with any of the reel formats, which can be cylindrical reel, conical reel, double cone reel, and others without changing the result of the present invention, once knowing the format to be worked.

The advantages of the invention developed are that on processing or twisting the thread with real torsion, the torsion variability on the thread is very small (theoretically it is nil), with which the mechanical characteristics of the twisted thread are increased when compared with the traditional system in which there are very high torsion variabilities.

The invention claimed is:

1. Thread twist system for twisting and spinning machines including a rotatable spindle, a reel attached to the spindle and disposed to rotate therewith, a ring disposed to extend around the reel, a rotatable runner carried on the ring and being rotatable at a variable rotational speed, and a thread feed pulley disposed to feed thread to the runner at a variable thread feed speed to fill the reel with thread, wherein the thread twist system comprises:

means for determining the rotational speed of the runner; and means for maintaining the ratio of the runner rotational speed and the thread feed speed at a constant value, whereby torsion variation of the twisted thread is minimized.

2. The thread twist system of claim 1 wherein the means for maintaining the ratio constant includes means for continuously varying the rotational speed of the runner.

3. The thread twist system of claim 1 wherein the means for determining the rotational speed of the runner includes an ultrasound sensor.

4. The thread twist system of claim 2 wherein the means for determining the rotational speed of the runner includes an ultrasound sensor.

* * * * *